US006565490B2

(12) United States Patent
O'Hearn

(10) Patent No.: US 6,565,490 B2
(45) Date of Patent: May 20, 2003

(54) EXERCISE MACHINE FOR WHEELCHAIR-BOUND USERS

(76) Inventor: Rodrick John O'Hearn, 1014 NW. 103rd Cir., Vancouver, WA (US) 98685

( * ) Notice: Subject to any disclaimer, the term of this patent is extended or adjusted under 35 U.S.C. 154(b) by 130 days.

(21) Appl. No.: 09/780,097

(22) Filed: Feb. 9, 2001

(65) Prior Publication Data

US 2002/0111254 A1 Aug. 15, 2002

(51) Int. Cl.[7] ..... A63B 21/00
(52) U.S. Cl. ..... 482/102; 482/103; 482/93
(58) Field of Search ..... 482/93–103, 138, 482/99, 112, 113, 120, 129, 130, 133; D21/673, 675

(56) References Cited

U.S. PATENT DOCUMENTS 3,438,627 A * 4/1969 Lanne ..... 482/103
4,549,733 A * 10/1985 Salyer ..... 482/103
4,603,855 A * 8/1986 Sebelle ..... 482/103
5,100,128 A 3/1992 Mabry et al. ..... 482/134
5,211,614 A * 5/1993 Henes ..... 482/102
5,449,336 A 9/1995 Sabel ..... 482/133
5,683,334 A 11/1997 Webber ..... 482/100
5,733,233 A 3/1998 Webber ..... 482/137
5,762,593 A 6/1998 Whiteley ..... 482/134
5,807,219 A 9/1998 Webber et al. ..... 482/134
5,951,444 A 9/1999 Webber ..... 482/99
6,338,701 B1 * 1/2002 Webber ..... 482/99

* cited by examiner

*Primary Examiner*—Jerome Donnelly
(74) *Attorney, Agent, or Firm*—Glenn C. Brown

(57) ABSTRACT

An exercise machine having a frame that readily receives a wheel chair and provides left and right exercise stations that are readily vertically adjustable and pivotable to provide a wide variety of exercises for the arms and legs.

20 Claims, 6 Drawing Sheets

EXERCISE MACHINE FOR WHEELCHAIR-BOUND USERS

BACKGROUND OF THE INVENTION

This invention is related to exercise machines, and in particular to exercise machines that accommodate a user in a wheel chair.

Many types and designs of exercise machines have been developed over the years. One popular form of exercise machine includes a space frame that includes pivoting arms which, when moved from one position to another, raise weights or otherwise provide resistance to the movement of the pivoting arm. The weights are in some instances removable from the machine to adjust the weight being lifted. In other instances, the weights are permanently affixed to the space frame and can be engaged in various combinations to adjust the weight. In still other designs, the resistance is provided not by weights, but by other devices such as springs, elastomeric materials, or pneumatic/hydraulic cylinders, all of which are intended to be encompassed in the term "weights" or "weight lifting" for purposes of this application, including the claims.

It is desirable that an exercise machine allows one to exercise different parts of the body. To do so, many exercise machines include multiple groups of weights to exercise different muscle groups of the arms, trunk and legs. Such exercise machines can include either a single or multiple locations around the machine from which to operate the weight stacks. Exercise machines can also include a single weight stack or resistance member that is operable by different mechanisms or from different locations to operate the single weight stack. This general type of machine is exemplified by that disclosed in U.S. Pat. Nos. 5,733,233; 5,807,219; and 5,683,334.

One group of users for whom known exercise machines are not particularly suitable are users who ambulate by way of wheelchair. The prior art includes at least one exercise machine adapted for use by a user in a wheel chair. U.S. Pat. No. 5,100,128 to Dabry et al. includes a frame that receives a wheel chair, and a handle structure pivotally mounted on the frame. The handle structure can be adjusted to raise and lower the handle relative to the user for a very limited number of exercises.

Known exercise machines are unsuitable for such users for several reasons. First, known exercise machines do not include a frame that conveniently receives a wheel chair without obstruction. Second, even exercise machines that can be used by users in a wheel chair do not provide adequate adjustability for users in a wheel chair. A need therefore remains for an improved exercise machine which is convenient for users in a wheel chair.

DETAILED DESCRIPTION

Figure 1:
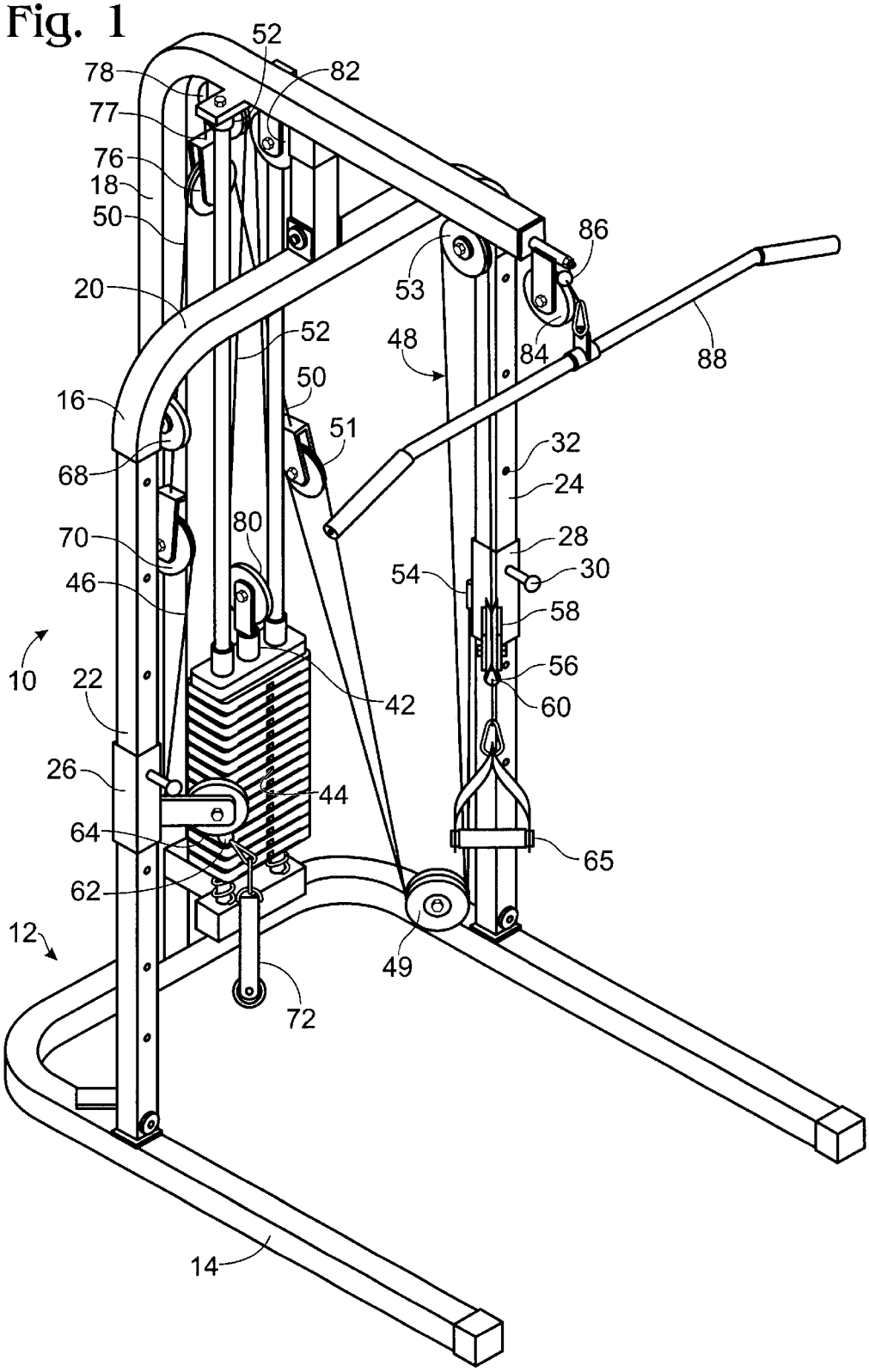
FIG. 1 is front left perspective view of a preferred embodiment of an exercise machine according to the present invention.
Figure 2:
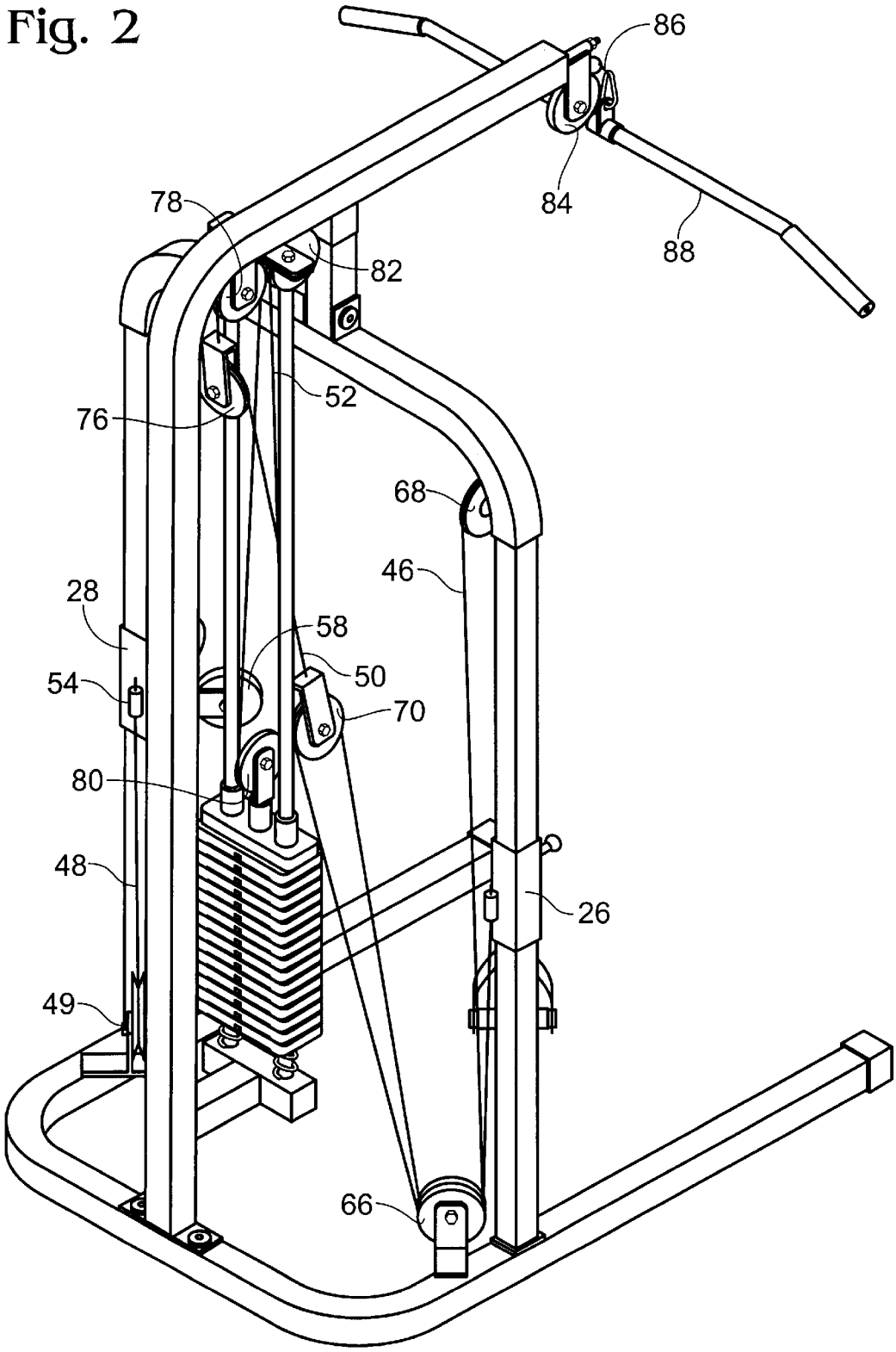
FIG. 2 is rear left perspective view of elevational view of the embodiment shown in FIG. 1.

Referring now to FIGS. 1 and 2, a preferred embodiment of an exercise machine according to the present invention is shown at 10. Apparatus 10 includes a frame 12 having a base frame 14, transverse frame 16, and an overhead frame 18. Transverse frame 16 is an inverted U-shaped member that includes legs 22 and 24, each of which is connected at its lower end to base frame 14. Each of legs 22 and 24 includes a portion on which respective sliding members 26 and 28 are mounted. Sliding members 26 and 28, which, in the claims, may be alternatively referred to as "handle assemblies", are adjustable to various heights along legs 22 and 24, and can be locked in position by insertion of pin 30 into one of holes 32. The operation of sliding members 26 and 28 will be described in greater detail below. In one preferred embodiment the resistance element is a weight stack 34 that is slidably mounted on a pair of vertical bars 36 and 38 that extend from overhead frame 14 to a bracket 40 connected to the lower portion of overhead frame 14. The weight stack 34 is of any suitable conventional design, and preferably includes a mechanism for selecting any of a variety of weight amounts for a particular user and exercise. In other embodiments, alternative resistance mechanisms such as springs, elastomeric materials, or pneumatic/hydraulic cylinders can be substituted. The term "resistance element" is intended to be defined broadly, and is not intended to be limited to the listed types of resistive element.

In this embodiment, a tube 42 extends downwardly through the weight stack. Tube 42 includes a number of horizontal, longitudinal holes corresponding with recesses 44 in each weight of the weight stack. To select a particular amount of weight, the user inserts a pin (not shown) into a recess 44 and through a corresponding hole through the tube. The top of tube 42 is connected to a pulley that is raised and lowered by the cable and pulley system, thereby raising and lowering the selected number of weights. Having described the frame of the apparatus, the pulley and cable system will now be described in greater detail.

Figure 3:
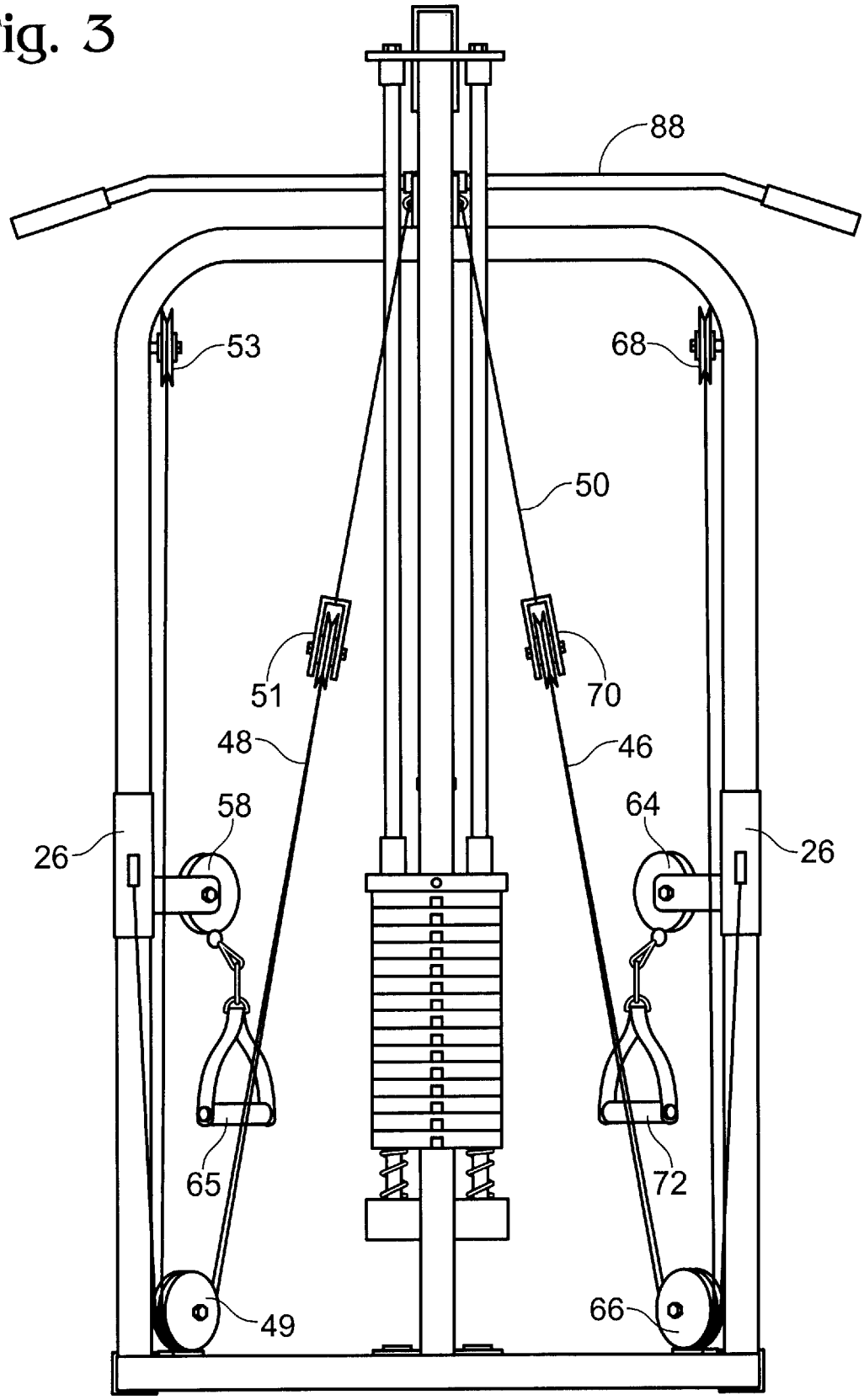
FIG. 3 is a rear elevational view of the embodiment shown in FIG. 1.
Figure 4:
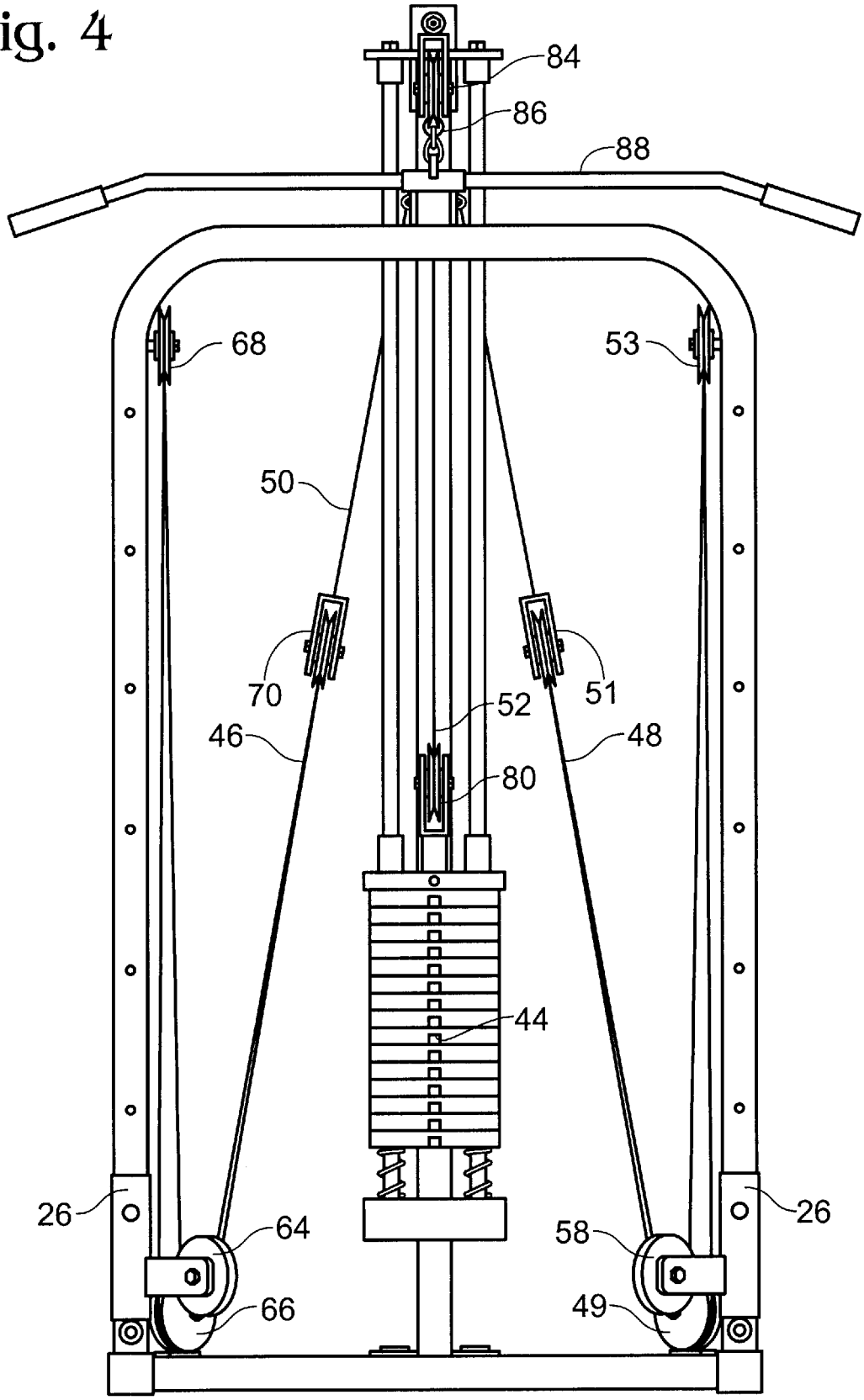
FIG. 4 is a front elevational view of the embodiment shown in FIG. 1.

Referring first to FIGS. 1–3, the cable and pulley system includes 4 cables: 46, 48, 50 and 52. Cables 46 and 48 are similar in operation, differing only in that they are mounted on the left and right sides of the apparatus. The following description of cable 48 will therefore serve to generally describe the operation of cable 46 as well. As a starting point in understanding the operation and one novel feature of the invention, note that both ends of cable 48 are mounted directly or indirectly onto sliding member 28. One end 54 of cable 48 is mounted in a fixed position on sliding member 28. Cable 48 is then routed through pulleys 49, 51, again through pulley 49 (a double pulley), then through pulley 53, and finally through pulley 58 which is pivotally mounted on sliding member 28. In this way, cable 48 is formed into a loop. The end 56 of cable 48 is then attached to a lug 60 that is too large to be drawn back through pulley 58, thereby limiting the travel of cable 48 and preventing end 56 from being pulled backward through the pulley. In this way, cable 48 is formed into a loop. Stated differently, lug 60 prevents the end 56 of cable 48 from passing through pulley 58, and in that way retains cable 48 in engagement with pulley 58. The maximum length of the loop formed by cable 48 is set. Cable 48 includes an end fitting 86 or configuration so that it can be attached to a variety of handles that a user then pulls away from sliding member 28. By doing so, lug 60 is pulled away from pulley 58, thereby shortening the loop formed in cable 48. As the loop in cable 48 is shortened, the weight stack is lifted as further described below. As mentioned above, cable 46 is similarly configured with its ends attached to sliding member 26, lug 62, and is engaged with pulley 64 in a like manner. This novel arrangement provides a significant advance over the prior art. It permits the sliding member, and therefore a handle attached to lug 60, to be raised and lowered simply by removing pin 30 and raising or lowering the sliding member along its leg. This adjustability provides a variety of positions from which to operate a handle 65, and permits a variety of leg and arm exercises to be achieved. This adjustment of the slider is achieved without the need to detach handle 65 or lug 60, and without the need to otherwise adjust the length of cable 48. Stated slightly differently, the arrangement of cable 48 as just described defines a first length of a looped cable 48 when lug 60 is in position next to pulley 58. Since the opposite end of cable 48 is also attached to slider 28, slider 28 can be moved up and down along leg 24 without varying the length of cable 48, and therefore without the need to adjust the length of cable 48 or the position of any of the pulleys.

Figure 5:
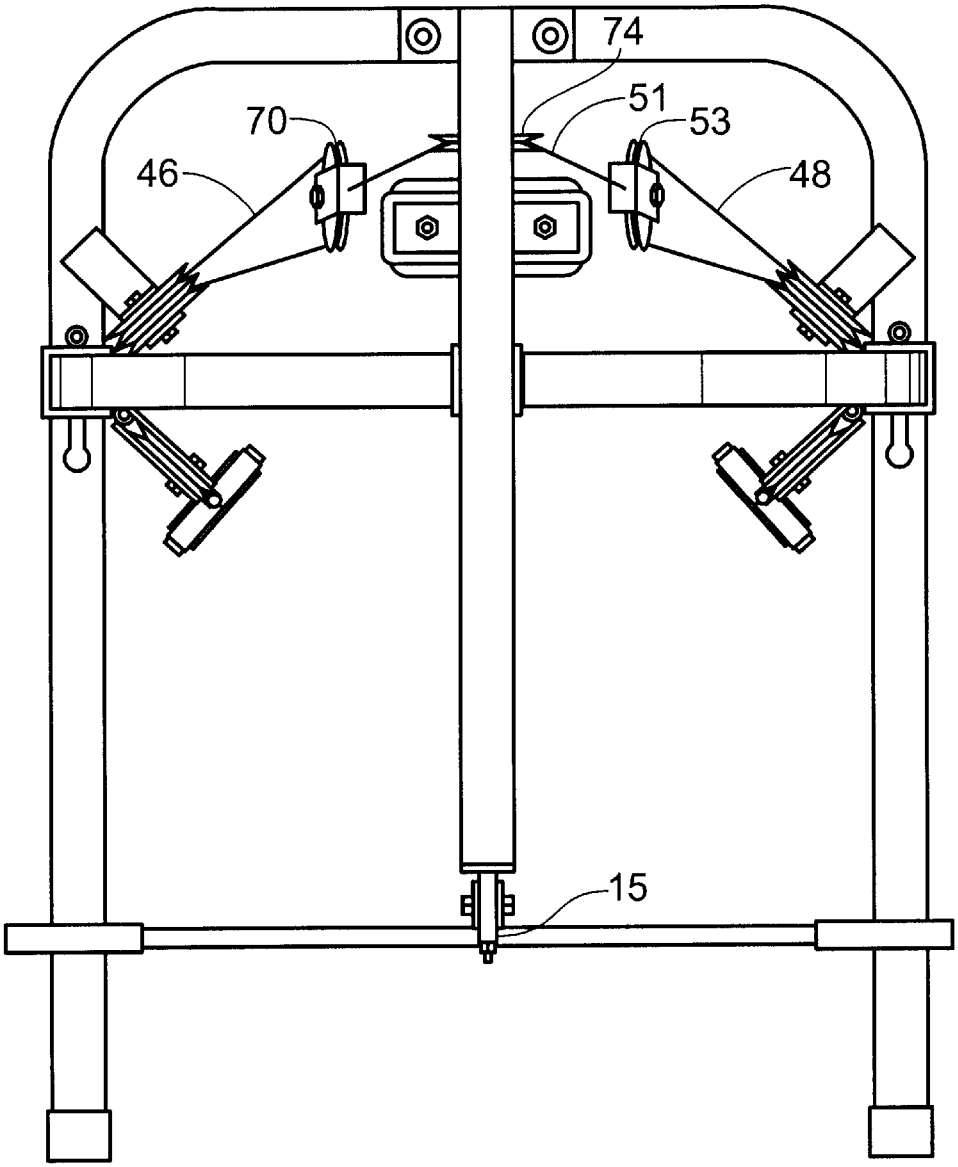
FIG. 5 is a top plan view of the embodiment shown in FIG. 1.
Figure 6:
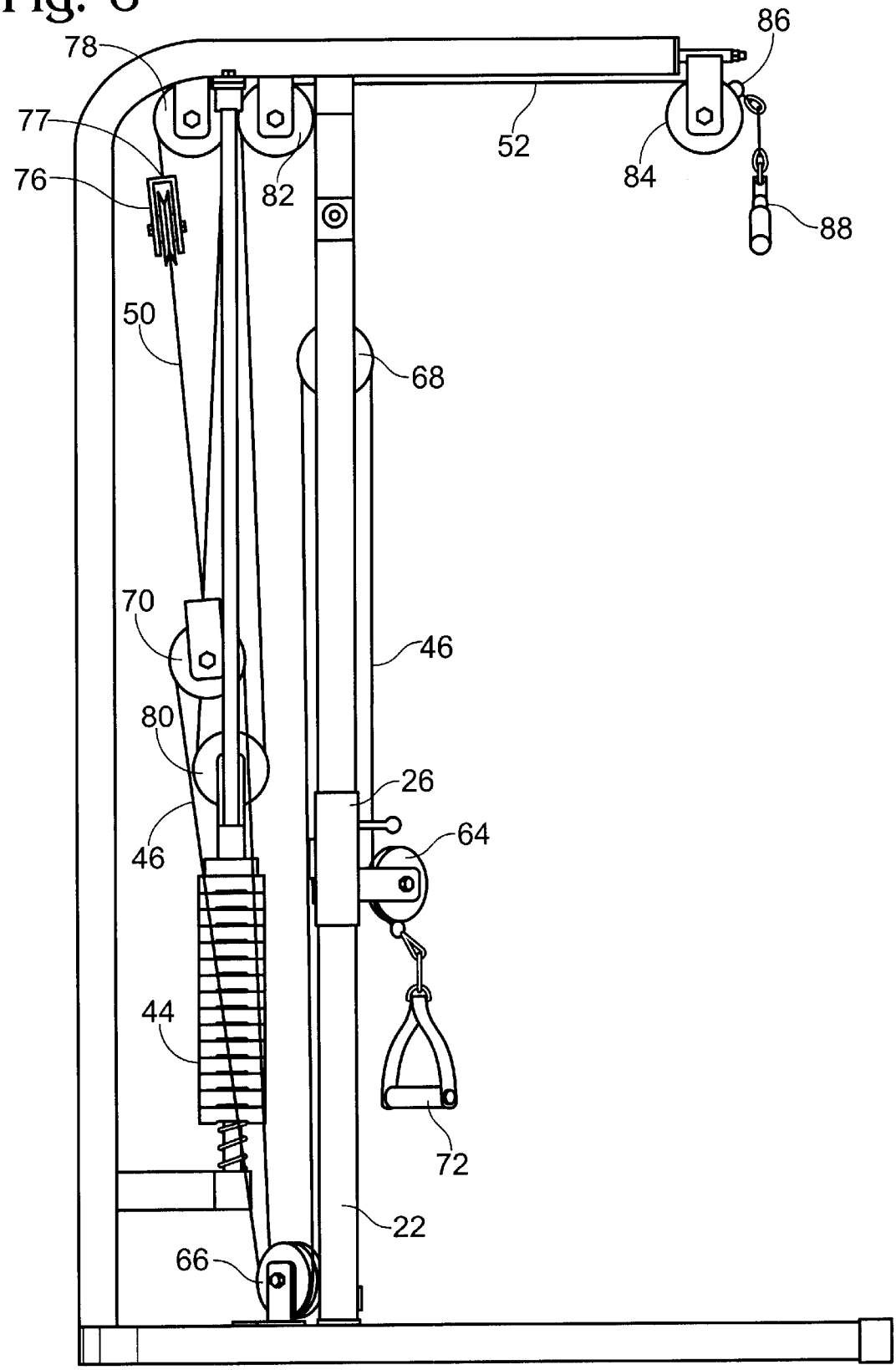
FIG. 6 is a side elevational view of the embodiment shown in FIG. 1.

Referring also now to FIGS. 5 and 6, the ends of cable 50 are connected to brackets supporting pulleys 53 and 68. Recall that cables 48 and 46 pass through pulleys 53 and 68 respectively. Cable 50 is itself routed through pulley 76. Pulley 76 is mounted in a bracket to which one end 77 of cable 52 is mounted in a fixed position. Cable 52 is routed through pulley 78 mounted on overhead frame 14. A lug 79 (not shown) is mounted near end 77 of cable 52 that prevents end 77 from passing through and disengaging from pulley 78. Cable 52 then passes through pulley 80 (mounted on the upper end of tube 42), pulley 82 (mounted on overhead frame 14), through pulley 84, and terminates at lug 86. Lug 86 prevents the end of cable 52 from being pulled back through and disengaging from pulley 84. Referring to FIG. 1, any of a variety of handles 88 can be attached to lug 86. This arrangement of cable 52 provides that when handle 88 is pulled, the opposite end 77 of cable 52 is held in place by lug 79. Cable 52 is pulled, pulley 80 and weight stack 44 are raised.

Alternatively, referring to FIGS. 1–4, weight stack 44 can be raised by operation of either handle 65 or handle 72, when a user pulls on handle 65, lug 60 is pulled away from pulley 48, shortening the length of the loop formed in cable 48 by a corresponding amount.

Since each of pulleys 49 and 53 are rigidly fixed to the frame, pulley 51 is pulled downwardly, pulling end 77 of cable 52 downwardly. Since the opposite end of cable 52 is retained in pulley 84 by lug 86, the shortening of cable 52 between pulleys 70 and 84 raises pulley 80 and along with it weight stack 44. Once again, weights are illustrated in this embodiment, but the shortening of cable 52 could just as well operate a resilient member, an elastomeric member, or a pneumatic or hydraulic cylinder.

The same result occurs if handle 72 is pulled. Cable 46 is similarly connected to sliding member 26 and routed through pulleys 64, 66, 68, and 70 (see FIG. 2). In a like manner, when handle 72 is pulled away from pulley 64, the loop in cable 46 is shortened by a corresponding amount, pulley 70 is pulled downwardly and pulley 80 is raised, raising weight stack 44 with it.

Note once again that with the novel arrangement of the present invention, sliding members 26 and 28, and therefore handles 65 and 72, can be adjusted vertically along legs 22 and 24 and yet operate in the same manner. Further adjustability is provided by pivotally mounting pulley 62 and 58 on their respective vertical legs. Handles 65 and 58 can then be pulled laterally or longitudinally from any vertical position along their respective vertical paths. Moreover, sliding members 26 and 28 can be adjusted to any position along legs 22 and 24 independently of one another, and without having to adjust any cable or pulley on the entire apparatus. This feature represents a significant advance over the prior art, and a significant advantage to a user in a wheel chair.

Having described preferred embodiments of the invention, those of skill in the art will will recognize that the described embodiments can be varied and altered in detail without departing from the scope of the following claims.

I claim:

1. An exercise machine (10) comprising:

a resistance member (44) mounted on a frame and a first pulley (80) operatively connected to the resistance member;

second (78), third (84) and fourth (82) pulleys mounted on the frame;

a first cable (52) engaged with the first, second, third and fourth pulleys, the pulleys and cable operable to operate the resistance member responsive to the first cable (52) being pulled by a first end away from the third pulley (84) or being pulled from a second end away from the second pulley (78); the first cable (52) having first and second retainers mounted on the respective first and second ends of the cable, the first retainer (60) preventing the first cable end from disengaging from the third pulley (84), the second retainer (79) preventing the second cable end from disengaging from the second pulley (78);

the frame including left and right vertical frame members;

left (26) and right (28) sliding brackets mounted on the respective left and right vertical frame members;

a fifth pulley (66) mounted on the left side of the frame and a sixth pulley (49) mounted on the right side of the frame;

a seventh pulley (64) mounted on the left sliding bracket, and an eighth pulley (58) mounted on the right sliding bracket;

a ninth pulley (70) above the fifth pulley (66) and a tenth pulley (51) above the sixth pulley (49), and a second cable (50) connecting the ninth and tenth pulleys to an eleventh pulley (76) mounted on the first cable second end;

a third cable (46) engaged with the fifth, seventh and ninth pulleys, the first end of the third cable (46) connected to the left slidable connector (26) and the second end of the third cable operably engaged with the seventh pulley (64), the third cable (46) operable to raise the weight by pulling the second end of the third cable away from the seventh pulley (64), thereby pulling the second end of the first cable (52) away from the second pulley; and, a fourth cable (48) engaged with the sixth pulley (58), eighth pulley (49) and tenth pulley (51), and twelfth pulley (53), the first end of the fourth cable connected to the right slidable connector and the second end of the fourth cable (48) operably engaged with the sixth pulley (58), the fourth cable (48) operable to raise the weight by pulling the second end of the fourth cable away from the sixth pulley (58), thereby pulling the second end of the first cable (52) away from the second pulley (78).

2. A exercise machine according to claim 1 further comprising the left slidable connector (26) movable to a plurality of vertical positions on the left vertical member, and the right slidable connector (28) movable to a plurality of vertical positions on the right vertical member.

3. A exercise machine according to claim 1 further comprising the frame having an opening for receiving a wheel chair, and having a portion for retaining the wheel chair in position while an occupant of the wheel chair operates the weight lifting apparatus.

4. A exercise machine according to claim 1 further comprising a handle connected to the first end of the first cable.

5. A exercise machine according to claim 1 further comprising a handle connected to the second end of the third cable.

6. An exercise machine according to claim 1 further comprising a handle connected to the second end of the fourth cable.

7. An exercise machine according to claim 1 further comprising a plurality of selectable weights mounted on the frame.

8. An exercise machine according to claim 1 further comprising the fifth and sixth pulleys being mounted adjacent the respective bases of the left and right vertical members.

9. An exercise machine comprising:

an operable resistance element;

a first cable (52) connected to the resistance element and a first handle (88), the first cable (52) operatively engaged with a first pulley assembly, and the first cable (52) operable to operate the resistance element;

a second cable (46) connected to the first cable (52), the second cable (46) operable to operate the first cable and thereby operate the resistance element;

the second cable (46) having first and second ends connected to a moveable second handle assembly (26) thereby forming the cable (46) into a loop, the second cable (46) and the second handle assembly (26) operable to position the second handle assembly (26) at a plurality of positions relative to a user; and, the second handle assembly (26) operable to shorten the loop formed by the second cable (46) and thereby operate the first cable (52) and operate the resistance member.

10. An exercise machine according to claim 9 further comprising:

a third cable (48) connected to the first cable (52), the third cable (48) operable to operate the first cable (52) and thereby operate the resistance element;

the third cable (48) having first and second ends connected to a moveable third handle assembly (28) thereby forming the third cable (48) into a loop, the third cable (48) and the third handle assembly (28) operable to position the third handle assembly (28) at a plurality of positions relative to a user; and the third handle assembly (28) operable to shorten the loop formed by the third cable (48) and thereby operate the first cable (52) and operate the resistance member.

11. An exercise machine according to claim 9 wherein the second looped cable (46) is operatively engaged with a second pulley assembly that is connected to the first cable.

12. An exercise machine according to claim 10 wherein the second looped cable (46) is operatively engaged with a second pulley assembly that is connected to the first cable (52).

13. An exercise machine according to claim 10 wherein the third looped cable (48) is operatively engaged with a third pulley assembly (52) that is connected to the first cable.

14. An exercise machine according to claim 10 wherein the second looped cable (46) is operatively engaged with a second pulley assembly, and wherein the third looped cable (48) is operatively engaged with a third pulley assembly, and wherein the second and third pulley assemblies connected to the first cable (52) comprises:

the second and third pulley assemblies connected to respective first and second ends of a fourth cable (50);

the fourth cable (50) operatively engaged with a fourth pulley assembly; and the fourth pulley assembly connected to the first cable (52).

15. An exercise machine according to claim 14 further comprising the second and third handle assemblies being operable concurrently or alternatively to operate the resistance element.

16. An exercise machine according to claim 9 wherein the first pulley assembly includes a pulley adjacent the first handle, a pulley connected to the resistance element, and a pulley adjacent an end of the first cable.

17. An exercise machine according to claim 11 wherein the second pulley assembly includes a pulley adjacent the second handle assembly.

18. An exercise machine according to claim 12 wherein the third pulley assembly includes a pulley adjacent the fourth handle assembly.

19. An exercise machine according to claim 17 wherein the pulley adjacent the second handle assembly is pivotably mounted.

20. An exercise machine according to claim 18 wherein the pulley adjacent the fourth handle assembly is pivotably mounted.

* * * * *